US009901766B2

(12) United States Patent
Ross

(10) Patent No.: US 9,901,766 B2
(45) Date of Patent: Feb. 27, 2018

(54) ROPE MACHINE

(71) Applicant: Exemplar Design, LLC, Mason, OH (US)

(72) Inventor: Adam L. Ross, Mason, OH (US)

(73) Assignee: Exemplar Design, LLC, Mason, OH (US)

( * ) Notice: Subject to any disclaimer, the term of this patent is extended or adjusted under 35 U.S.C. 154(b) by 0 days.

(21) Appl. No.: 14/707,595

(22) Filed: May 8, 2015

(65) Prior Publication Data

US 2015/0321048 A1 Nov. 12, 2015

Related U.S. Application Data

(60) Provisional application No. 61/991,191, filed on May 9, 2014.

(51) Int. Cl.

| | |
|---|---|
| ***A63B 21/00*** | (2006.01) |
| ***A63B 21/06*** | (2006.01) |
| ***A63B 21/062*** | (2006.01) |
| ***A63B 21/018*** | (2006.01) |
| ***A63B 71/00*** | (2006.01) |
| ***A63B 5/20*** | (2006.01) |
| ***A63B 21/055*** | (2006.01) |
| ***A63B 23/12*** | (2006.01) |
| ***A63B 22/00*** | (2006.01) |

(52) U.S. Cl.

CPC ..... *A63B 21/00* (2013.01); *A63B 21/018* (2013.01); *A63B 21/055* (2013.01); *A63B 21/0552* (2013.01); *A63B 21/06* (2013.01); *A63B 21/0628* (2015.10); *A63B 21/1488* (2013.01); *A63B 21/151* (2013.01); *A63B 22/0005* (2015.10); *A63B 23/12* (2013.01); *A63B 2210/00* (2013.01)

(58) Field of Classification Search

CPC . A63B 21/151; A63B 21/055; A63B 21/0552; A63B 21/0555; A63B 21/0557; A63B 21/018; A63B 21/156; A63B 21/04; A63B 21/0417; A63B 21/0414; A63B 21/0609; A63B 21/062; A63B 21/0622; A63B 21/0624; A63B 21/0626; A63B 21/15; A63B 21/015; A63B 21/012; A63B 21/0181; A63B 21/0428

USPC ..... 482/37

See application file for complete search history.

(56) References Cited

U.S. PATENT DOCUMENTS 4,487,413 A * 12/1984 Fall ..... A63B 21/0023 482/23
5,485,951 A * 1/1996 Phillips ..... B65D 5/10 229/109
7,507,190 B2 * 3/2009 Piane, Jr. ..... A63B 23/1209 482/123
7,537,554 B2 * 5/2009 Zhuang ..... A63B 21/023 482/121
7,553,262 B2 * 6/2009 Piane, Jr. ..... A63B 21/0628 482/102

(Continued)

*Primary Examiner* — Nyca T Nguyen
(74) *Attorney, Agent, or Firm* — Baker & Hostetler LLP

(57) ABSTRACT

The present disclosure provides a rope-type conditioning/exercise apparatus that provides movements and resistance similar to prior devices requiring significantly longer ropes by providing ropes that are connected to sliders on sliding tubes, wherein the resistance to upward and downward movement of the sliders can be adjusted as desired by a user to create.

4 Claims, 6 Drawing Sheets

(56) References Cited

U.S. PATENT DOCUMENTS

| | | | | |
|---|---|---|---|---|
| 2004/0018920 | A1* | 1/2004 | Simonson | A63B 21/154 482/99 |
| 2006/0160681 | A1* | 7/2006 | McBride | A63B 1/00 482/123 |
| 2011/0281697 | A1* | 11/2011 | Reyes | A63B 21/062 482/97 |
| 2013/0065737 | A1* | 3/2013 | Habing | A63B 21/156 482/102 |
| 2013/0296144 | A1* | 11/2013 | Gvoich | A63B 21/062 482/102 |
| 2014/0121071 | A1* | 5/2014 | Strom | A63B 21/062 482/99 |
| 2014/0141946 | A1* | 5/2014 | Huber | A63B 21/15 482/110 |
| 2015/0087486 | A1* | 3/2015 | Franks | A63B 21/0442 482/129 |
| 2015/0133278 | A1* | 5/2015 | Braier | A63B 21/0442 482/135 |
| 2015/0265869 | A1* | 9/2015 | Hemstreet | A63B 21/015 482/110 |
| 2015/0283421 | A1* | 10/2015 | Gaylord | A63B 21/151 482/110 |

* cited by examiner

ROPE MACHINE

TECHNICAL FIELD

The present disclosure relates generally to exercise devices, and more particularly, to exercise devices utilizing ropes in connection therewith.

BACKGROUND

Currently, there are numerous types of conditioning ropes on the market. Conditioning ropes come in different materials, sizes and colors. Conditioning ropes can also be made with plastic, rubber or metal handles for gripping. Different attachments can be connected to current conditioning ropes such as carabineers or d-rings. Although these ropes exist, they require a significant amount of space, due to the length of rope required, in order to generate the desired torque resistance necessary to meet the desired training requirements.

More specifically, typically, conditioning ropes come in lengths of 15 ft., 30 ft., 40 ft., 50 ft. or 100 ft. and in diameters of either 1.5 in or 2 in. This means that a large amount of space is needed to use the ropes for exercise. For example, if one were to use a 50 ft rope, they would need at least 25 ft of space to use. In any public or private training facility, this can be very inconvenient and can limit the ability to use the conditioning rope. Accordingly, there is a need for a conditioning rope-type exercise machine that provides the benefits of conventional rope conditioning while not requiring the amount of space needed to utilize the machine.

SUMMARY

The present disclosure provides a rope-type conditioning/exercise apparatus that provides the same motion and uses as prior art conditioning ropes, while limiting the space needed to perform exercises using the previously mentioned ropes. The disclosure provides a rope-type conditioning/exercise apparatus that provides improvement to a user's overall health and fitness. More specifically, the present disclosure provides a rope-type conditioning apparatus that requires only a relatively small amount of space in comparison to prior art rope conditioning equipment and apparatuses.

In some embodiments, the present disclosure provides a rope-type conditioning/exercise apparatus that provides multiple levels of difficulty and may include adjustment mechanisms to mimic different lengths and sizes of conditioning ropes. In some aspects of the present disclosure, the adjustment mechanisms may include ways of varying resistance on the rope-type conditioning apparatus including, but not limited to, through the use of weights, friction, resilient cords, etc.

DETAILED DESCRIPTION

Figure 1:
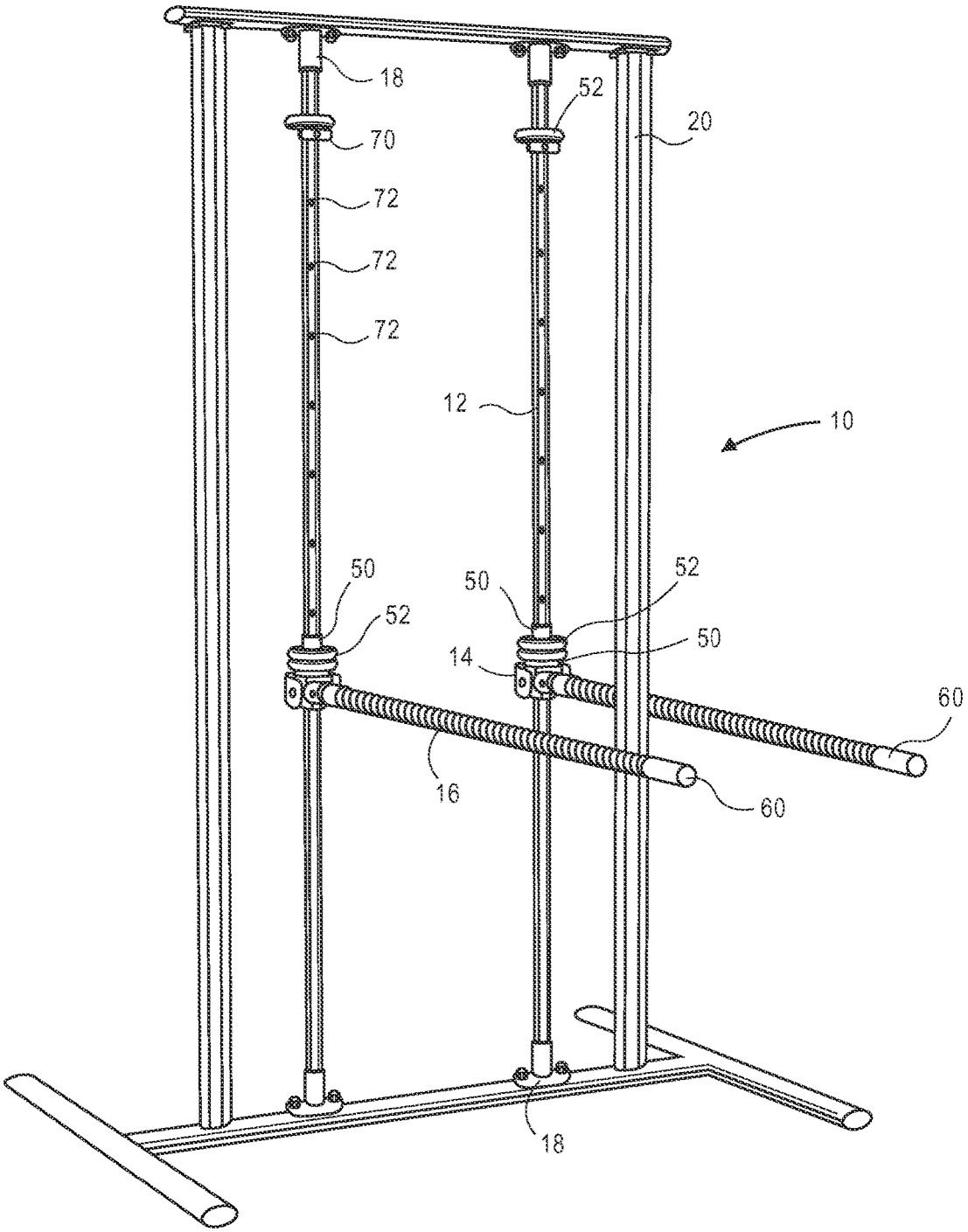
FIG. 1 is a front perspective view of a rope-type conditioning/exercise apparatus in accordance with the present disclosure.

In accordance with one embodiment of the present disclosure, as best shown in FIG. 1, a rope-type conditioning apparatus 10 comprises at least one sliding tube 12, at least one slider 14, and at least one rope 16 connected thereto. It should be recognized that while the sliding tube 12 is referred to as a "tube" herein, the sliding tube 12 may be comprised of a rail, rod, etc., of practically any shape, size, construction, etc. The important aspect for the construction of the sliding tube 12 herein to be operable in accordance with the present disclosure is that it be capable of being mounted in a generally vertical manner and that it be shaped such that the slider 14 may be mounted for sliding movement thereon with the rope 16 connected thereto. The tube 12 may include a stopper 18 on the ends thereof to provide a cushioned stop for movement of the slider 14 during operation.

Figure 7:
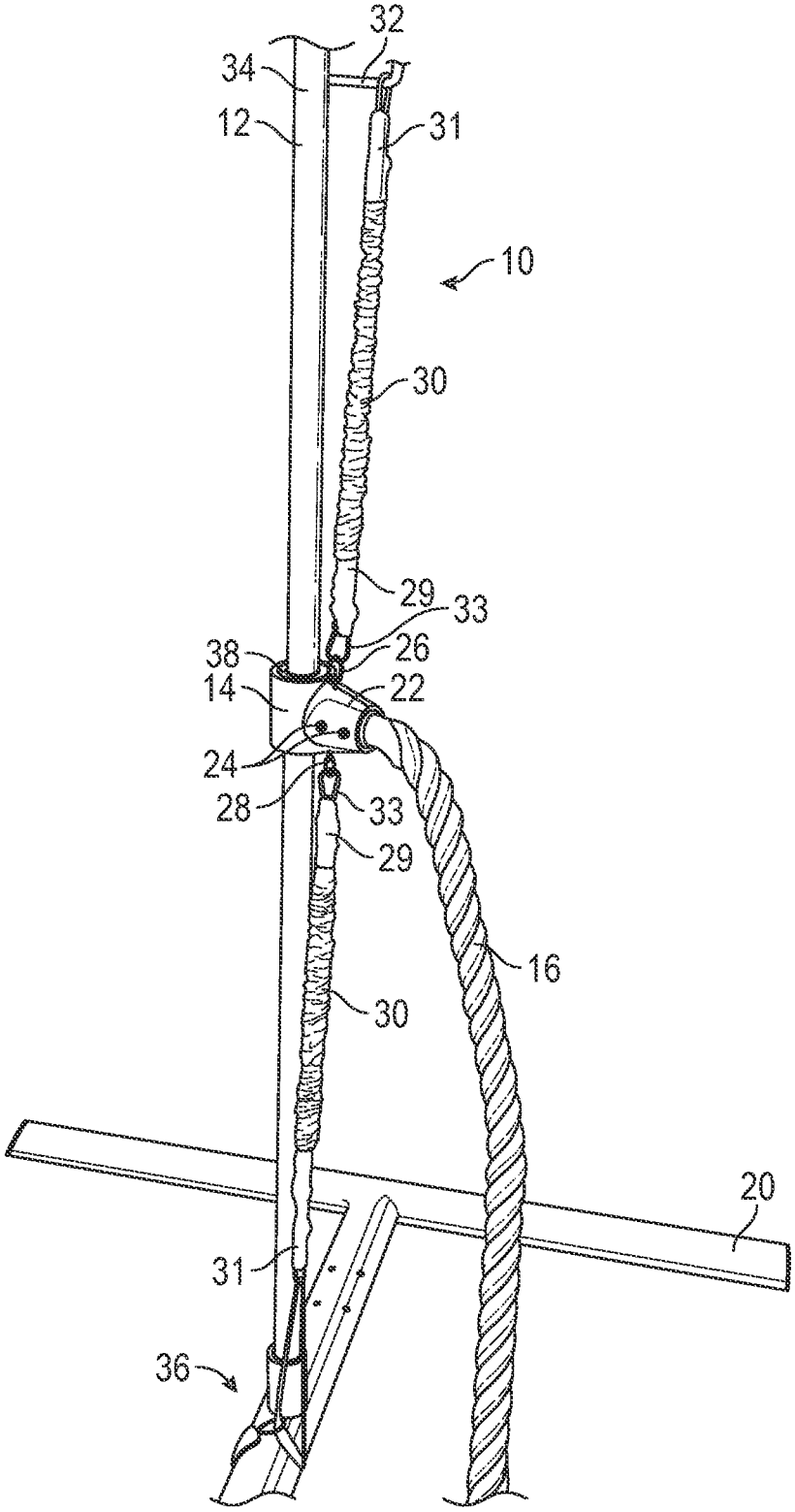
FIG. 7 is a side perspective view of an alternate embodiment of a rope-type conditioning/exercise apparatus in accordance with aspects of the disclosure.

The sliding tube 12 is preferably mounted generally vertically on or in a frame 20, although it may be direct mounted on a wall, floor, etc. In accordance with the embodiment shown in FIG. 7, the slider 14 may be provided with a mounting flange 22 for securely receiving one end of the rope 16 therein. The rope 16 may be secured therein with fasteners 24 such as screws, bolts, etc. or any other manner as is known in the art. The flange 22 may include an upper mount 26 and a lower mount 28 for securely receiving a first end 29 of an elastic band 30. A second end 31 of elastic band 30 may be secured to a mount 32 positioned on an upper portion 34 of the frame 20 or may be directly attached to a lower portion 36 the frame 20. In accordance with one aspect of the disclosure, the slider 14 may be provided with a bearing 38, such as a ball bearing, to facilitate sliding of the slider 14 on the tube 12. In alternate embodiments, carriages including wheels, Teflon, low-friction surfaces, etc. may be used as desired.

Figure 2:
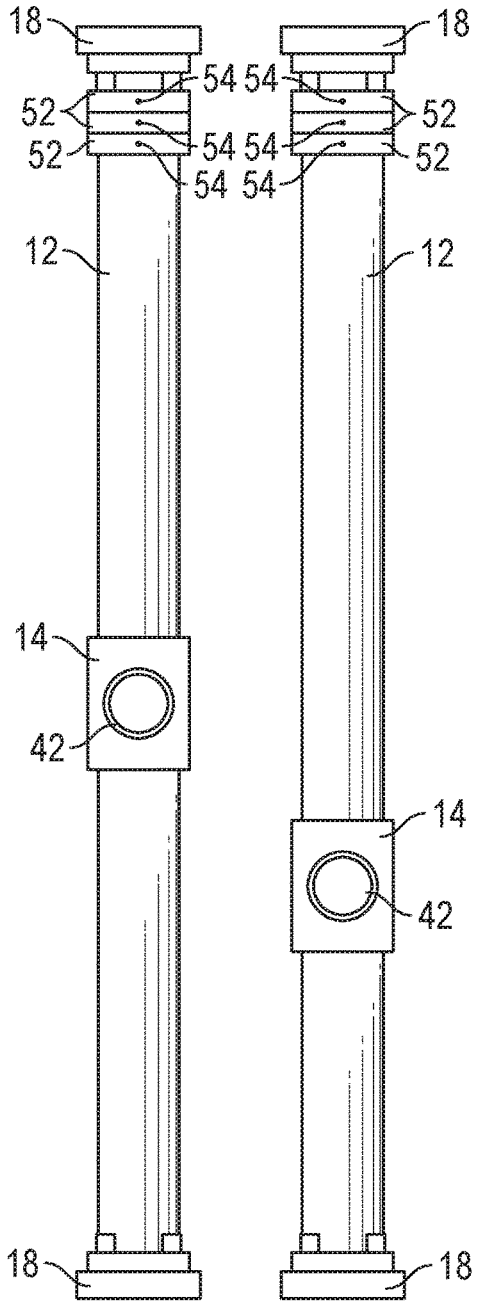
FIG. 2 is a front elevational view of a portion of a rope-type conditioning/exercise apparatus in accordance with aspects of the disclosure.
Figure 3:
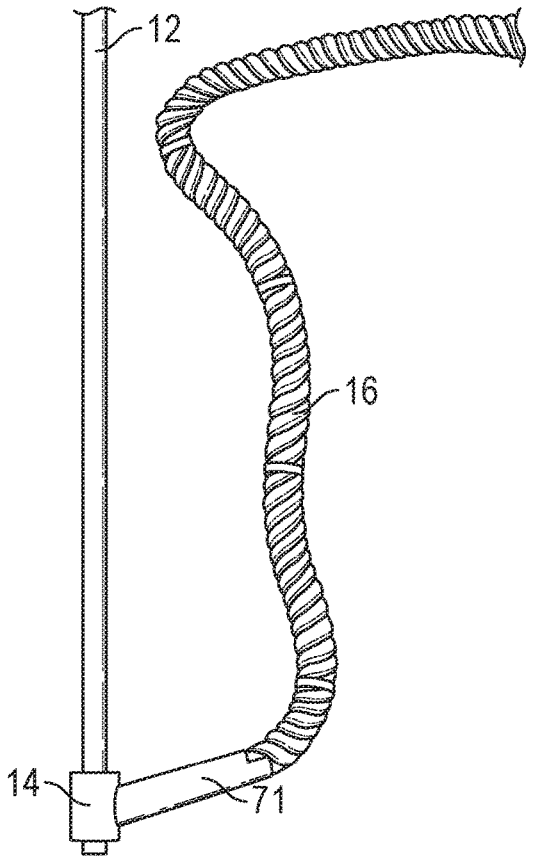
FIG. 3 is a side elevational view of a portion of a rope-type conditioning/exercise apparatus in accordance with aspects of the disclosure.
Figure 5:
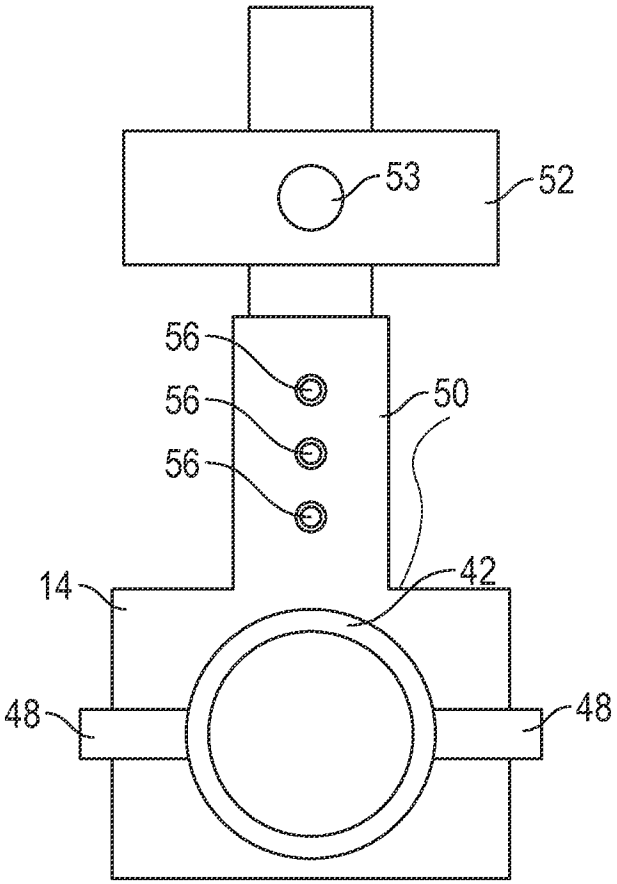
FIG. 5 is a front elevational view of the portion of the rope-type conditioning/exercise apparatus of FIG. 4.
Figure 4:
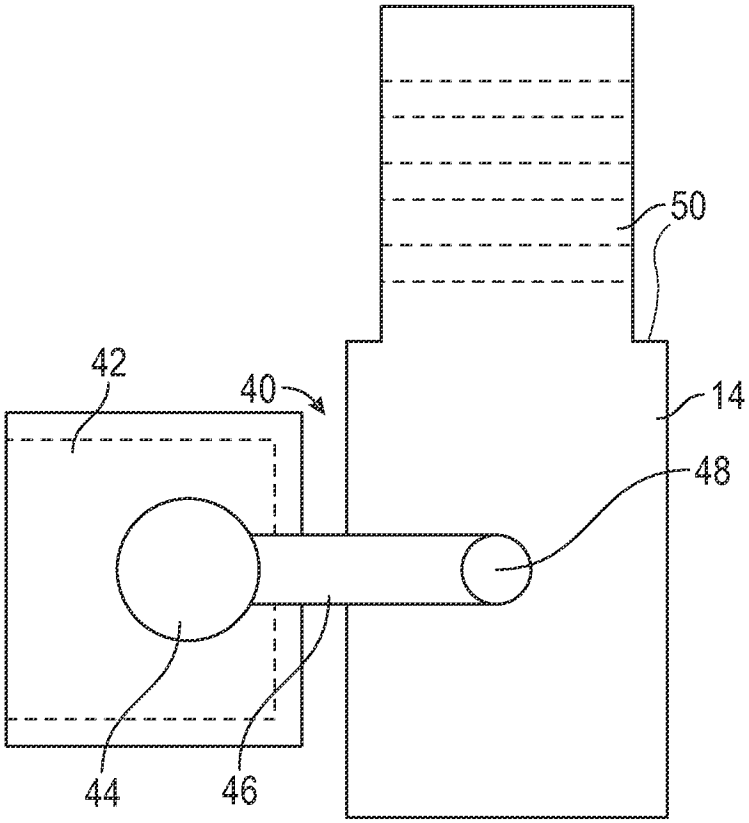
FIG. 4 is a side elevational view of a portion of a rope-type conditioning/exercise apparatus in accordance with aspects of the disclosure.
Figure 6:
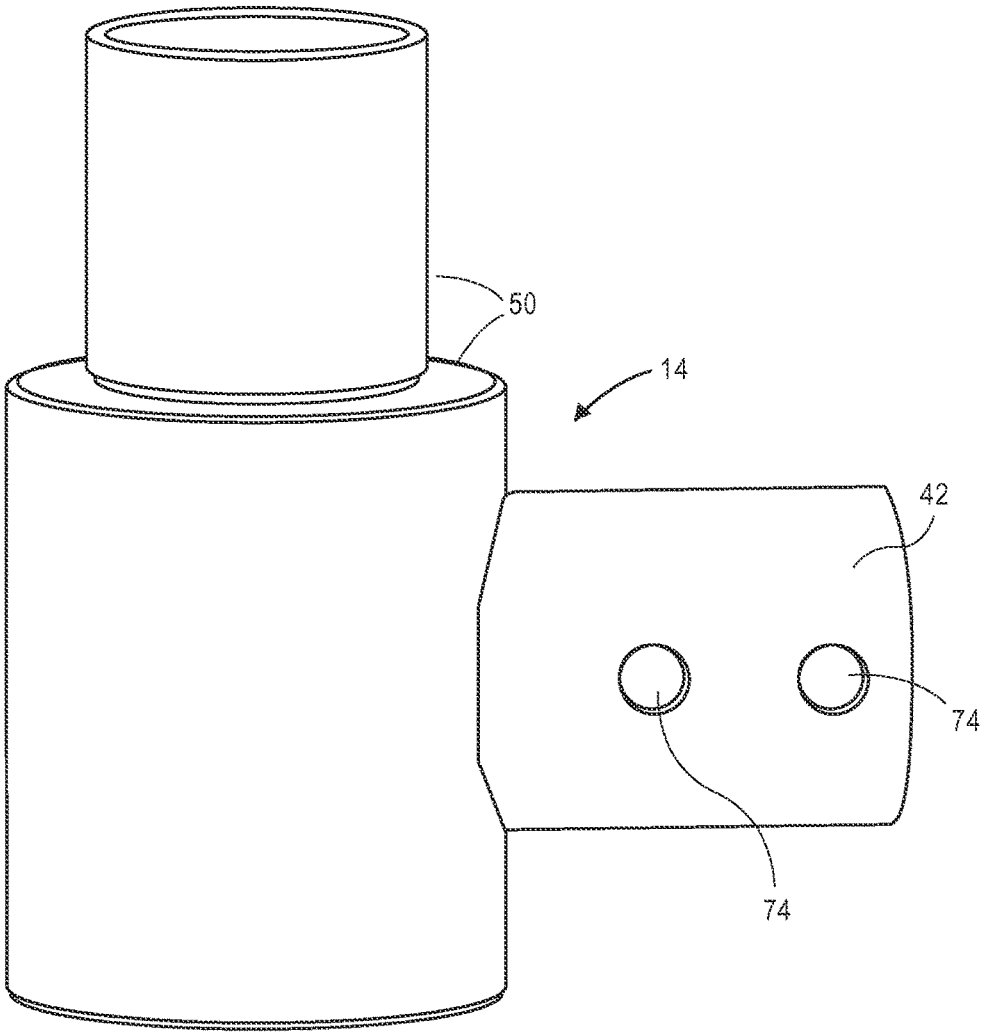
FIG. 6 is a side elevational view of a portion of a rope-type conditioning/exercise apparatus in accordance with aspects of the disclosure.

As seen best in FIGS. 4 and 5, in accordance with one aspect of the disclosure, the rope 16 may be secured to the slider 14 by a hinge mechanism 40. The hinge mechanism 40 may include a collar 42 for securely receiving the rope 16 therein and the rope 16 may be secured to the collar 42 by screws, bolts, crimping, etc. or other securement methods as are known to those of ordinary skill in the art using through bores 74. A pivot 44 may be provided on the collar 42 for pivotably receiving an arm 46 on one end thereof. A pivot 48 may also be provided on the slider 14 for pivotably receiving another end of the arm 46 thus providing a double pivot for the rope 16. The use of a double pivot such as this, while not required, increases the freedom of movement of the rope 16 when being used. Conversely, however, a design having a single pivot, or no pivot (such as shown in the embodiment illustrated in FIGS. 2, 6 and 7) is operable within the scope of the disclosure. The slider 14 may be provided with a seat 50 for receiving weights 52 (shown in FIGS. 1 and 2) thereon to provide adjustability to the workout. The weights 52 may be provided with bores 54 therethrough to receive an adjustment pushpin 53 to secure the weights 52 to the slider 14 through corresponding bores 56 therethrough in a manner known in the art for exercise and conditioning equipment.

As best shown in FIG. 1, the sliding tube 12 may be provided with through bores 72 for receiving pushpin 70. Pushpin 70 may thus be used as a stop to prevent weights 52 from falling onto the slider 14. Alternatively, pushpin 70 can operate as a stop to restrict movement of the slider 14 on the tube 12, both above and below slider 14.

Figure 8:
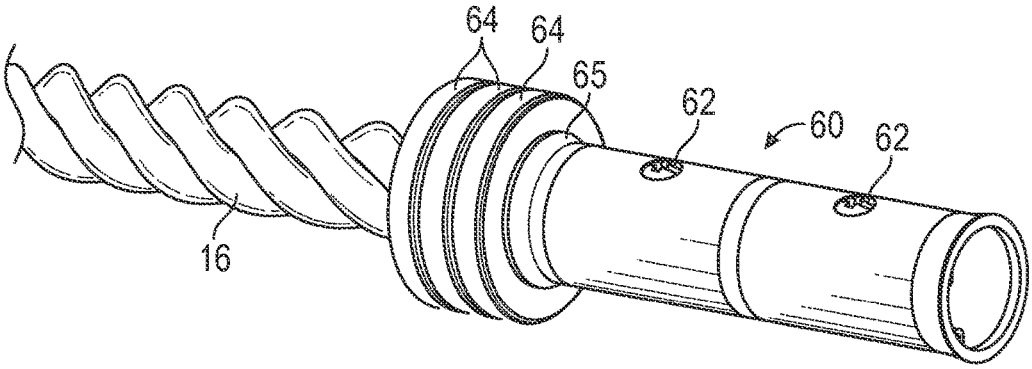
FIG. 8 is a side perspective view of a handle having a removable weight thereon for use in accordance with embodiments of the present disclosure.
Figure 9:
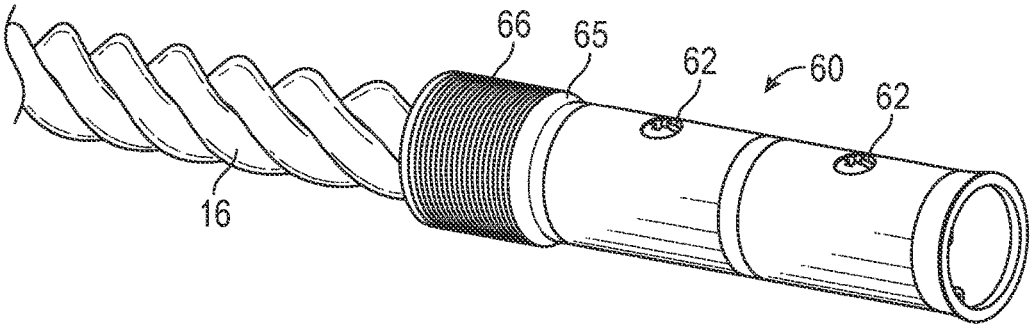
FIG. 9 is a side perspective view of the handle of FIG. 8 showing the weight removed.

As best shown in FIGS. 8 and 9, the rope 16 may be provided with gripping handle 60 on the end of the rope 16 not connected to the slider 14. As with the slider 14 above, the end of the rope 16 may be secured in the gripping handle 60 in any manner known in the art including the use of screws 62. In order to add adjustability to the workout, the gripping handle 60 may be provided with adjustable weights 64. The adjustable weights 64 may be secured to the handle 60 in any known manner including through the use of threads 66 provided on the base portion 65 of the handle 60 to receive corresponding threads (not shown) on the interior portion of the weights 64. It is to be understood, however, other methods of securing the weights 64 to the handle 60 are operable and considered within the scope of the disclosure.

In accordance with alternate embodiments of the disclosure, the rope 16 may have a poly boot handle on one side of the rope 16 and a crimped metal tube 71 on the other. The metal tube 71 may have at least one hole drilled through it (not shown) so that the rope 16 can attach thereto in the manner described above. It is to be understood, in accordance with the disclosure, there are many ways that resistance and/or weight may be added to the slider 14 in order to change and/or modify the desired exercise. Non-limiting examples of the foregoing include, but are not limited to, weights, friction devices (including selectable friction devices), resistance bands, gearing, etc., as is known in the art of fitness equipment.

In accordance with one aspect of the disclosure, a user may use the rope-type conditioning/exercise apparatus 10 as follows. The user may first decide the amount of resistance she desires. The resistance can be adjusted by pulling the pushpin 53 from the desired weight 52 then sliding it onto the seat 50 of the slider 14 and pushing the pushpin 53 into the weight bore 54 and corresponding bores 56 on the seat thereby securing the weight(s) 52 to the slider 14. The user may then grab the handles 60 on the conditioning rope 16 and perform the exercise they desire. At any time, weights 52 can added for more resistance, or removed for less resistance. As mentioned before, the weights 52 also mimic various rope 16 sizes so the user can perform the correct intended exercises. Similarly, exercise can be performed with the embodiment shown in FIG. 5 by connecting various elastic bands 30 to the slider 14 through the mounts 26 on the slider 14 and to a fixed end either on the frame 20, such as the mount 32, or to the frame 20 itself, or to another fixed point. As is known in the art, carabiners 33 may be used for this purpose.

In accordance with some aspects of the present disclosure, the disclosure may be modified in the following exemplary, non-limiting, ways without departing from the scope of the disclosure. For example, the hinge mechanism 40 may be replaced with a welded tube to hold the conditioning rope 16. Similarly, the sliding tube 12 may be made of any material and could be made straight or curved. The weights 52 may be attached to the slider 14 in many different ways are known to those of ordinary skill in the art. The frame 20 may be free standing as shown, wall-mounted, part of a different piece of equipment, door-mounted, etc. The conditioning rope 16 may have any sort of handle 60, such as a plastic or metal handle, to perform different exercises. In addition, a seat or bench may be incorporated so the user can sit in order to exercises specific parts of the body.

A non-limiting, exemplary description of how the rope-type conditioning/exercise apparatus 10 of the present disclosure may be fabricated is as follows. Initially it is noted that standard injection molding and fabrication techniques, as would be known to those of ordinary skill in the art, may be used. The rope 16 may be fabricated like typical conditioning ropes. A rubber or plastic handle may be placed over one end of the conditioning rope 16, then a metal crimping process may be used to attach a metal end to the other end of the rope 16. All metal parts, including the bearing mechanisms, sliding tubes, weights, and frame 20 components may be fabricated and welded as customary. All screws, bolts, and other hardware for the utilized may be fabricated in ways that are typical to the making these pieces.

The rope-type conditioning/exercise apparatus of the present disclosure may be used in multiple fields. Fields include, but are not limited to, the medical field, health and fitness field, outdoor games field, social games field, and arcade field.

It will be appreciated that the foregoing description provides examples of the disclosed apparatus and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain functions is intended to indicate a lack of preference for those functions, but not to exclude such from the scope of the disclosure entirely unless otherwise indicated. All methods described herein can be performed in any suitable order unless otherwise indicated herein or otherwise clearly contradicted by context.

I claim:

1. A conditioning/exercise apparatus comprising:

a frame having an upper portion and a lower portion;

a sliding tube mounted in a first orientation in said frame;

a slider including a generally cylindrical portion mounted on said sliding tube for sliding movement on said sliding tube, said slider including a mounting flange thereon extending perpendicularly from said generally cylindrical portion, the flange having an upper mount and a lower mount;

at least two elastic bands each having a first end and a second end wherein the first ends of each band are mounted on said upper mount and lower mount, respectively and wherein the opposite end of each band is mounted to said upper portion of said frame and said lower portion of said frame, respectively such that each band exerts a force on the slider generally opposed to the force of the other band; and a conditioning rope securely connected in said mounting flange and secured by fasteners.

2. The conditioning/exercise apparatus of claim 1 wherein said frame is freestanding.

3. The conditioning/exercise apparatus of claim 1 wherein said sliding tube is a generally cylindrical tube and said slider includes a bearing therein to facilitate sliding of the slider on the sliding tube.

4. The conditioning/exercise apparatus of claim 1 further comprising a handle attached to one end of the conditioning rope.

* * * * *